US010746119B2

(12) United States Patent
Hauser et al.

(10) Patent No.: US 10,746,119 B2
(45) Date of Patent: Aug. 18, 2020

(54) PRESSURE DETERMINATION IN A FUEL INJECTION VALVE

(71) Applicant: CONTINENTAL AUTOMOTIVE GMBH, Hannover (DE)

(72) Inventors: Christian Hauser, Lappersdorf (DE); Gerd Rösel, Regensburg (DE); Markus Stutika, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 204 days.

(21) Appl. No.: 15/572,116

(22) PCT Filed: Apr. 14, 2016

(86) PCT No.: PCT/EP2016/058173

§ 371 (c)(1),
(2) Date: Jan. 25, 2018

(87) PCT Pub. No.: WO2016/180594

PCT Pub. Date: Nov. 17, 2016

(65) Prior Publication Data

US 2018/0163657 A1 Jun. 14, 2018

(30) Foreign Application Priority Data

May 8, 2015 (DE) ..... 10 2015 208 573

(51) Int. Cl.
*F02D 41/20* (2006.01)

(52) U.S. Cl.
CPC ..... *F02D 41/20* (2013.01); *F02D 2041/2003* (2013.01); *F02D 2041/2055* (2013.01);
(Continued)

(58) Field of Classification Search
CPC ..... F02D 41/20; F02D 2041/2055; F02D 2041/2003; F02D 2200/0604
See application file for complete search history.

(56) References Cited

U.S. PATENT DOCUMENTS

2012/0185147 A1* 7/2012 Beer ..... F02D 41/20 701/102

FOREIGN PATENT DOCUMENTS

CN 101598090 A 12/2009
CN 102052178 A 5/2011
(Continued)

OTHER PUBLICATIONS

International Search Report and Written Opinion dated Jul. 1, 2016 from corresponding International Patent Application No. PCT/EP2016/058173.

(Continued)

*Primary Examiner* — Sizo B Vilakazi

(57) ABSTRACT

The invention provides a device and a method for determining a pressure of a fuel (19) which is to be injected into a combustion chamber (23) via a controllable closure element (11) of a solenoid valve (1), wherein the method comprises: generating a current flow (i) through a coil (3) of the solenoid valve (1) in order to generate a magnetic field, in order to generate a magnetic force acting on an armature (9), which magnetic force shifts the armature (9) in the direction of the opening of the closure element (11), determining a magnitude of a magnetic flux (Ψ) of the magnetic field before or when a first state (I) at which the armature starts to shift the closure element is reached, and determining a magnitude of the pressure on the basis of the determined magnitude of the magnetic flux.

12 Claims, 5 Drawing Sheets

(52) U.S. Cl.
CPC ..... *F02D 2041/2058* (2013.01); *F02D 2200/0604* (2013.01)

(56) References Cited

FOREIGN PATENT DOCUMENTS

| | | | | |
|---|---|---|---|---|
| DE | 19544207 | A1 | 6/1997 | |
| DE | 19800760 | A1 * | 8/1998 | ..... F02D 41/222 |
| DE | 19800760 | A1 | 8/1998 | |
| DE | 102007048609 | A1 | 4/2009 | |
| DE | 102008002019 | A1 | 12/2009 | |
| DE | 102008040244 | A1 | 1/2010 | |
| DE | 102009043124 | B4 | 6/2011 | |
| DE | 102010063009 | A1 | 6/2012 | |
| DE | 102011075935 | A1 | 11/2012 | |
| EP | 2796695 | A1 | 10/2014 | |
| JP | H10227268 | A | 8/1998 | |

OTHER PUBLICATIONS

German Office Action dated Feb. 1, 2016 for corresponding German Patent Application No. 10 2015 208 573.2.
English Abstract of DE 10 2007 048 609 A1.
English Abstract of DE 10 2008 040 244 A1.
English Abstract of DE 10 2010 063 009 A1.
English Abstract of DE 10 2011 075 935 A1.
English Abstract of DE 195 44 207 A1.
English Abstract of DE 198 00 760 A1.
Korean Office Action dated Sep. 7, 2018 for corresponding Korean patent application No. 10-2017-7032163.
Chinese First Office Action dated Mar. 27, 2020 for the counterpart Chinese Patent Application No. 201680026776.8.

* cited by examiner

PRESSURE DETERMINATION IN A FUEL INJECTION VALVE

FIELD OF INVENTION

The present invention relates to a method and a device for determining a pressure of a fuel, wherein a magnetic flux within a solenoid valve is used for this purpose. In addition, the present invention relates to a pressure measuring system having a solenoid valve and a device for determining a pressure of a fuel.

BACKGROUND

Fuel injection systems are conventionally composed of an electronic part and a hydraulic part. In the hydraulic part, the fuel is compressed to a predefined pressure, so that during the injection process into a combustion chamber, such as for example a cylinder, the requested quantity of fuel or a desired quantity of fuel can be introduced with optimized atomization. In order for the method to proceed correctly, it is necessary to have knowledge of the fuel pressure which is typically measured by means of pressure sensors. Errors or deviations of the measured fuel pressure from the actual fuel pressure can give rise to deviating injection quantities, to non-optimum atomization of the fuel and therefore to worsening of emissions or worsening of the performance of the internal combustion engine. It is therefore basically necessary to determine the fuel pressure with sufficient accuracy, which is typically done by means of pressure sensors. In addition it is necessary to check the plausibility of the measured values supplied by the pressure sensor, since during operation it can lead to drifting or even to failure of the sensor.

Measurement of the fuel pressure is conventionally carried out using a pressure sensor. The checking of electrical parameters of the fuel pressure sensor can serve here to check the functioning of the sensor or to check the plausibility.

However, it has been observed that a pressure measurement by means of a pressure sensor cannot be carried out in all situations with sufficient accuracy and reliability. Plausibility checking of the measured values of a pressure sensor by monitoring electrical parameters is also not reliable in all situations and circumstances. In addition, under certain circumstances, a pressure measurement by means of a pressure sensor may not have sufficient accuracy.

SUMMARY

An object of the present invention is therefore to propose a method and a device for determining a pressure of a fuel, which permit precise and reliable pressure determination or, in particular, can be used for checking the plausibility of pressure measurements of a pressure sensor.

The object is achieved by means of the subject matter of the independent claims. The dependent claims specify particular embodiments of the present invention.

According to one embodiment of the present invention, a method is made available for determining a pressure of a fuel which is to be injected into a combustion chamber via a controllable closure element of a solenoid valve. In this context, the method comprises generating a current flow through a coil of the solenoid valve, in order to generate a magnetic field, in order to generate a magnetic force acting on an armature, which magnetic force shifts the armature in the direction of the opening of the closure element (or at any rate applies a force in this direction), determining a magnitude of a magnetic flux of the magnetic field before or when a first state at which the armature starts to shift the closure element is reached, and determining a magnitude of the pressure on the basis of the determined magnitude of the magnetic flux.

In order to inject fuel into a combustion chamber, such as for example a cylinder, a solenoid valve or a solenoid injector can be used. Such a solenoid injector (also referred to as a coil injector) has a coil which, when current flows through the coil, generates a magnetic field, as a result of which a magnetic force is applied to an armature, with the result that the armature shifts in order to bring about opening or closing of a nozzle needle or of a closure element in order to open or close the solenoid valve. If the solenoid valve or the solenoid injector has what is referred to as an idle stroke between the injector and the nozzle needle or between the armature and the closure element, shifting of the armature does not immediately also lead to shifting of the closure element or of the nozzle needle, but only does so after shifting of the armature by the magnitude of the idle stroke has occurred.

When a voltage is applied to the coil of the solenoid valve, the armature is moved in the direction of a pole shoe (pole piece) by electromagnetic forces. As a result of mechanical coupling (e.g. a mechanical contact), the nozzle needle or the closure element also moves after the idle stroke has been overcome, and clears, given corresponding shifting, injection holes for feeding fuel into the combustion chamber. If current continues to flow through the coil, the armature and nozzle needle or closure element move further until the armature moves against and abuts the pole shoe. The distance between the abutting of the armature against a driver element of the closure element or the nozzle needle and the abutting of the armature against the pole shoe is also referred to as the needle stroke or working stroke. In order to close the valve, the exciter voltage which is applied to the coil is switched off and the coil is short-circuited, with the result that the magnetic force is reduced. The coil short-circuit causes a polarity reversal of the voltage owing to the reduction in the magnetic field stored in the coil. The level of the voltage is limited with a diode. Owing to a restoring force, which is made available, for example, by a spring, the nozzle needle or closure element including the armature are moved into the closed position. In this context, the idle stroke and the needle stroke are passed through in the reverse order.

The time of the start of the needle movement when the solenoid valve opens is dependent on the magnitude of the idle stroke. The time when the needle or the armature abuts the pole shoe is dependent on the magnitude of the needle stroke or working stroke. The injector-specific chronological variations in the start of the needle movement (opening) and the end of the needle movement (closing) can result in different injection quantities when the electrical actuation is identical.

The method according to the invention can partially be implemented using hardware and/or software. In particular, the method can be implemented in a diagnostic device or, in particular, also in an engine control device. The method can be carried out in a workshop, in an assembly factory or in a vehicle which is operating. The method can be carried out during a normal driving mode of the vehicle, in particular at specific time intervals in which it is possible to use a specific coil actuation profile to actuate the coil of the solenoid valve. This actuation signal or voltage actuation profile can have a reduced boost voltage (e.g. lower than 65 V) during a boost phase, wherein e.g. a voltage between 3 V and 12 V is applied.

The current flow can be generated by applying a voltage to the coil, in particular according to a specific voltage profile which has a boost phase, a holding phase and a brief closing phase. The armature can comprise, in particular, a slotted armature or an armature which is formed by a plurality of layers of a ferromagnetic material, which layers are respectively electrically insulated from one another in order to reduce Eddy currents. In this case, a conventionally used magnitude of between 60 V and 70 V can also be used for the boost voltage.

The magnetic flux can be determined either before or when the first state is reached. In other embodiments, the magnetic flux is determined both before and when the first state is reached (or even afterwards) and could be combined, for example, averaged, in order to increase the accuracy further, for example.

Embodiments of the invention are based on the observation that the fuel pressure has an influence on a magnetic flux during opening (and also during closing) of a solenoid valve. The pressure of the fuel can therefore be inferred from monitoring the magnetic flux.

The fuel pressure is typically measured in a conventional standard pressure sensor in the rail. However, at this location there may be a different pressure present than that which is actually present at the injector, i.e. solenoid valve. Deviations can be caused e.g. by throttle effects on lines, on the injector etc. While the pressure according to this embodiment of the present invention is measured by means of the method according to the invention using the solenoid valve itself or using the injector (in particular Eddy-current-reduced injector with standard actuation of the coil), the actual pressure within the injector or the solenoid valve can be determined, which gives rise to more accurate pressure determination and therefore gives rise to increased injection accuracy.

The magnetic flux can be calculated e.g. from measured current (by the coil of the solenoid valve), measured voltage (which is applied to the coil of the solenoid valve) and a known ohmic resistance of the coil. The magnetic flux can e.g. be recorded or plotted against the measured current in a coordinate system in which the current is plotted on one axis and the magnetic flux on the other axis, in order to obtain a state trajectory or Ψ-I curve.

The first state can be determined here e.g. from a shape of the curve or state trajectory. The first state can occur e.g. at an inflection in the state trajectory at which a gradient changes sign. This embodiment is particularly beneficial if the solenoid valve does not have an idle stroke.

The closure element can be embodied e.g. as a nozzle needle which has a closure ball at one end in order to make contact with a conical seat in the closed state and to clear the conical seat in the opened state.

If the armature abuts the closure element (or a driver element which is fixedly connected to the closure element) during an opening process of the solenoid valve, a further increase in force may also be necessary before the closure element is shifted (in particular via the driver element) together with the armature in the direction of an open position, since the closure element can be prestressed in the open state by means of a restoring spring. Nevertheless, an inference about the pressure can be made from this section of the trajectory (that is to say before the movement of the closure element) if the magnetic flux in this section is considered. When the first state is reached, the closure element starts to shift together with the armature in the direction of an opened position. The pressure can be determined as a function of the determined magnitude of the magnetic flux, in particular if a reference curve and/or a sensitivity of the magnetic flux as a function of the pressure or a sensitivity of the pressure as a function of the magnetic flux is also used.

A pressure determination of the injection systems with magnetic injectors can therefore be carried out on the basis of Ψ-I curves. In this context, the changes in the Ψ-I curves can permit the detection of the mechanical deformations (evaluation of the gap changes) and the force changes (evaluation of the inflection points according to the force in proportion to $\Psi^2$) which occur in the case of pressure changes. The pressure values, which are determined according to embodiments of the present invention, can be used as plausibility checks of the values of a pressure sensor or, for example, as an equivalent value if the pressure sensor fails (emergency running). The measurement can be carried out as an absolute measurement or as a relative pressure measurement. In the case of an absolute pressure measurement, curves can be recorded at known pressures. Measurements can be carried out on solenoid valves with unknown fuel pressure while making comparisons with these reference curves. In addition, a reference curve or a plurality of reference curves can be recorded at a known pressure or known pressures (e.g. at 0 bar when the vehicle is stationary). The difference between curves of different pressures from the reference curve can then be calculated with pressure sensitivities (e.g. $\Delta\Psi/\Delta$–Pressure).

A relative pressure measurement can be carried out in such a way that the difference between curves or the difference between magnetic fluxes can be considered to be a measure of the change in pressure. The calculation of the change in pressure can be made on the basis of the difference using a pressure sensitivity.

The pressure measurement can be carried out in the normal driving mode if the injection behavior (in particular spray formation) is not significantly changed (emissions) by the actuation. With specific actuation profiles (voltage profile which defines the voltage applied to the coil plotted over time), the actuation can be possible at e.g. with a reduced fuel pressure even before the vehicle starts in order to determine reference curves, e.g. 0 bar (no or very small injection quantities), or in the start/stop mode or after the end of the driving mode when pressure is still present. Basically it could be considered that the added fuel quantities and their combustion do not cause the emission limits to be exceeded.

In the case of an injector with reduced Eddy current or with no Eddy current, the pressure measurement can be carried out using the standard actuation profile during the normal vehicle mode. The pressure values which are determined can be corrected, for example, in respect of temperature and fuel pressure. The actuation and evaluation can be carried out with a specific measuring device. However, the method is preferably carried out with the (modified) engine control device which is present.

A sensitivity of the magnitude of the magnetic flux as a function of the magnitude of the pressure or a sensitivity of the magnitude of the pressure as a function of the magnitude of the magnetic flux may be known from previous measurements on the (same) solenoid valve. In this case, the magnitude of the pressure can be determined as a determination of a change in pressure on the basis of the determined magnitude of the magnetic flux (in particular also on the basis of a previous determined magnitude of the magnetic flux) and the known sensitivity. This can correspond to a series expansion of a function, wherein the process is aborted after the first element or the linear element. In this way, the method can be carried out easily. Various sensitivities can be defined in various pressure ranges or various ranges of the magnetic flux, and that sensitivity which is closest to the measured pair of magnetic flux and current can be used.

The magnitude of the pressure can also be determined from reference data which contain at least one magnitude of the magnetic flux at a known pressure, or can contain, for example, a total trajectory during various states of the armature, which can comprise various pairs of magnetic flux and current during an opening process or a closing process of the solenoid valve. In this way, an absolute pressure determination can also be carried out.

According to one alternative, the magnitude of the magnetic flux can be determined (precisely) when the first state is reached (i.e. precisely when the closure element starts to be moved by the armature). In this case, the magnitude of the pressure can be determined as being proportional to the square of the magnitude of the magnetic flux. This can arise from the fact that the magnetic force is proportional to the square of the magnetic flux. In the first state, a force equilibrium can just occur between the force built up owing to the pressure and the force built up owing to the magnetic field. In this way, a precise pressure determination could be carried out. In addition, just one value of the magnetic flux has to be used.

According to another alternative (which can, however, also be used together with the first alternative), the magnitude of the magnetic flux will be determined before the first state is reached (i.e. when the armature bears on the driver element or the closure element, but does not shift it since the force which is built up on the basis of the pressure is greater than the force which is built up on the basis of the magnetic field), and the magnitude of the pressure and/or a magnitude of a total stroke, consisting of an idle stroke and a working stroke, of the armature can be determined therefrom (determination of the total stroke because the flux determination is before point I, i.e. before the armature movement), wherein, in particular, a sensitivity of the magnitude of the magnetic flux can be taken into account as a function of the magnitude of the stroke (idle stroke or working stroke). The advantage of this alternative is that the measurement can be carried out without opening the valve (i.e. without fuel flowing into the combustion chamber). In this way, emissions can be reduced or avoided. If the solenoid valve additionally also has an idle stroke, the determination of the magnitude of the magnetic flux can be carried out after a state in which the armature abuts the driver element or the closure element or makes contact therewith is reached and also before the first state is reached.

According to one option in the method, pairs of a magnitude of a current and a magnitude of the magnetic flux which can correspond to a state trajectory of the closure element or of the armature during a flowing process of the solenoid valve (in particular when a voltage according to an actuation profile is applied to the coil) can be considered, in particular in a graph (in particular plotted in a graph). In this context, the first state can be associated with a pair in which a sign of a gradient changes along the state trajectory. In this way, the first state can be detected in a simple and reliable way. In the first state, the curve can have a pole.

In a graph in which the current through the coil is plotted on the abscissa, and the magnetic flux is plotted on an ordinate, the first state can be identified as being assigned to the location at which a positive gradient changes into a negative gradient. The first state can also be identified as being assigned to a location between a section of a positive gradient and a section of a negative gradient. Simple identification of the first state is therefore made possible. For this purpose, e.g. a second derivative can be considered, or a pole can be searched for in a graph of the first derivative.

Initially a boost voltage (e.g. square-wave), in particular between 3 V and 65 V, and then a holding voltage, in particular between 6 V and 14 V can be applied to generate the current flow through the coil. A total duration of such a voltage profile can be e.g. between 1 ms and 3 ms, wherein the duration of the application of the boost voltage can be, for example, between 0.2 and 0.7 ms. Other parameters are possible.

It should be understood that features which have been described, made available or applied individually or in any combination in conjunction with a method for determining a pressure of a fuel can likewise be made available or applied individually or in any combination to a device for determining a pressure of a fuel, according to embodiments of the present invention and vice versa.

According to one embodiment of the present invention, a device, in particular an engine control unit, is made available for determining a pressure of fuel which is to be injected into a combustion chamber via a controllable closure element of a solenoid valve. In this context, the device comprises a driver device for generating a current flow through a coil of the solenoid valve, in order to generate a magnetic field in order to generate a magnetic force acting on an armature, which magnetic force shifts the armature in the direction for opening the closure element, and a determining module which is designed to determine a magnitude of a magnetic flux of the magnetic field before or when a first state in which the armature starts to shift the closure element is reached and determine a magnitude of the pressure on the basis of the determined magnitude of the magnetic flux.

The engine control device can be used and installed in a conventional vehicle. The determining module can comprise an arithmetic/logic unit and also e.g. a memory where, for example, reference data can be stored. An increasing magnetic force which acts on the armature has been built up during the course of reaching the first state, during which process the closure element (or a driver element thereof) is continuously in contact with the armature or in abutment therewith. At a determined increased magnetic field, which corresponds to an increased magnetic force, there can be a force equilibrium between the force arising owing to the force pressure and a force acting owing to the magnetic field. Starting from this moment, shifting occurs of both the armature and of the closure element in the direction of an opened position of the solenoid valve.

According to another embodiment of the present invention, a pressure measuring system is made available which comprises a solenoid valve having a controllable closure element, a coil and an armature, wherein a magnetic field is generated by a current flow through the coil, in order to generate a magnetic force on the armature, which magnetic force shifts the armature in the direction of opening the closure element, and a device according to one of the embodiments described above for determining a pressure of a fuel which is to be injected into a combustion chamber via the closure element of the solenoid valve, wherein the armature comprises, in particular, a slotted ferromagnetic material and/or layers of ferromagnetic material which are electrically insulated from one another, in order to reduce Eddy currents.

If the armature comprises an Eddy-current-reduced material, the coil can be actuated according to a standard actuation profile, wherein a boost voltage of approximately 65 V is used. In other cases, relatively low boost voltages can be used.

BRIEF DESCRIPTION OF THE DRAWINGS

Embodiments of the present invention will now be explained with reference to the appended drawings. The invention is not restricted to the explained or illustrated embodiments.

DETAILED DESCRIPTION

Figure 1:
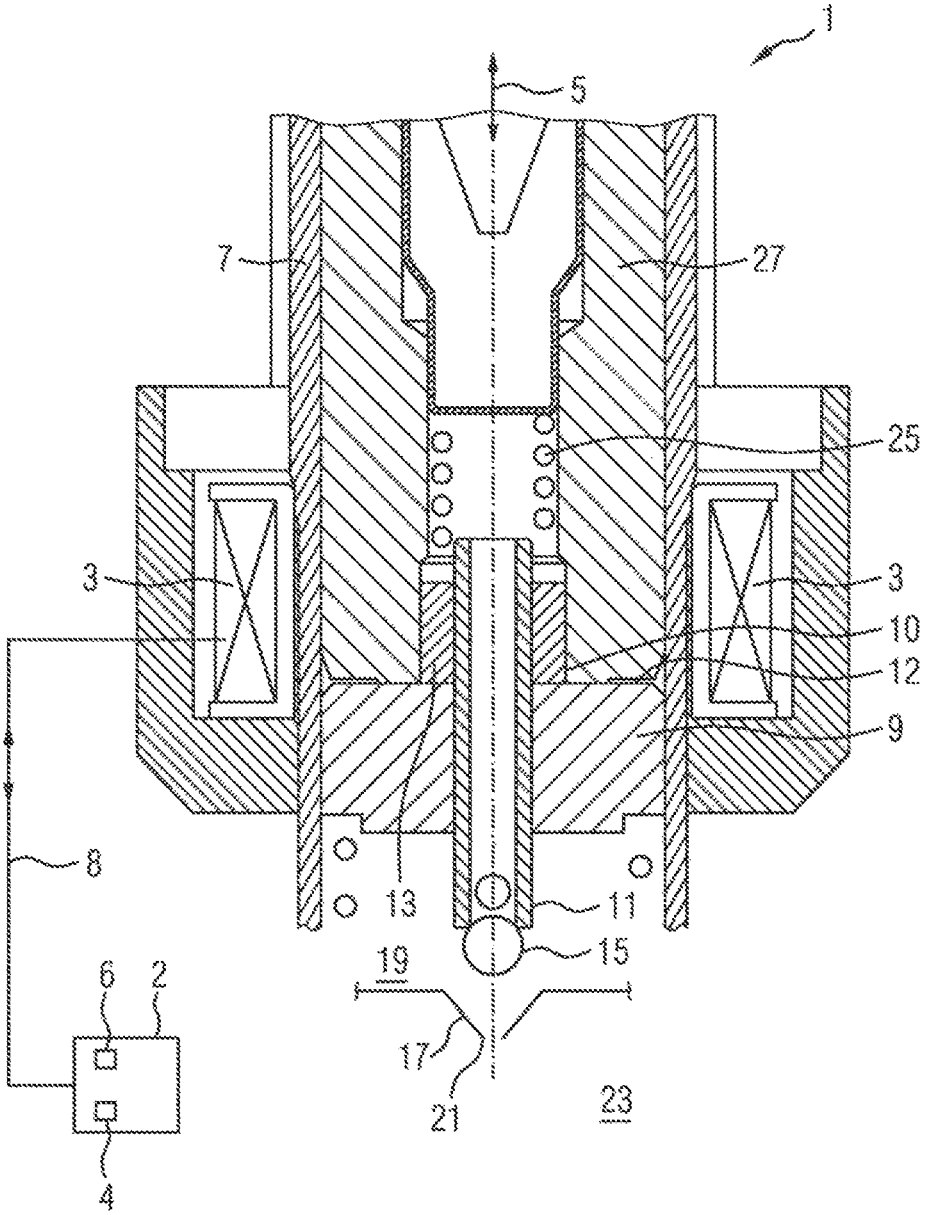
FIG. 1 illustrates, in a schematic sectional view, a solenoid valve for which the pressure of fuel can be determined according to a method, e.g. using a device for determining a pressure according to embodiments of the present invention.

The solenoid valve 1 illustrated in a schematic sectional view in FIG. 1 has a coil 3 to which a voltage can be applied, with the result that a current flows through the coil 3 in order to build up a magnetic field. In this context, the magnetic field extends essentially in a longitudinal direction 5 of a guide cylinder 7. The magnetic field acts on a ferromagnetic armature 9 which can be shifted within the guide cylinder 7. By shifting the armature 9, it is possible to shift a nozzle needle 11 or a closure element of the solenoid valve 1 in the longitudinal direction 5, in particular by forming contact between the armature 9 and an annular driver element 13, which is fixedly connected to the closure element 11.

In the opened state illustrated in FIG. 1, a closure ball 15 composed of a conical seat 17 is pulled back, with the result that fuel 19 can pass through an opening 21 in the seat into a combustion chamber 23 for combustion. In the completely opened state, the armature 9 bears on the pole shoe 27, and therefore cannot be shifted further upward.

In a closed state of the solenoid valve 1 (not illustrated in FIG. 1), the armature 9 is shifted downward by a restoring spring 25 when a current is not flowing through the coil 3, with the result that the driver element 13 is also shifted downward, together with the closure element 11, in such a way that the closure ball 15 bears in a seal-forming fashion against the conical seat 17, with the result that fuel 19 cannot pass into the combustion chamber 23. In this state of the armature 9, in which it is shifted downward, the driver element 13 and also the armature 9 have executed at least one working stroke 12 (during which the armature 9 and the driver element 13 are in contact) and optionally also an additional idle stroke 10 in which there is a gap between the armature 9 and the driver element 13.

FIG. 1 also illustrates a device 2 for determining a pressure of a fuel 19. The device 2 comprises here a driver device 4 which can generate a current flow through the coil 3 (according in particular to an actuation profile). In addition, the device comprises a determining module 6 which is designed to determine a magnitude of a magnetic flux of the magnetic field before or when a first state in which the armature 9 starts to shift the closure element 11 (in particular together with the driver element 13) is reached, and which is also designed to determine a magnitude of the pressure on the basis of the determined magnitude of the magnetic flux. For this purpose, the device 2 can receive e.g. current and voltage via the control and data line 8 which is connected to the coil 3, and can calculate a magnetic flux therefrom.

Embodiments of the present invention permit the pressure of fuel 19 to be determined by determining and evaluating the magnetic flux which passes through the armature 9 and partially through the pole shoe 27 and the driver element 13.

The flux can be determined by means of the measurement and analysis of the concatenated magnetic flux Ψ. In this context, the concatenated magnetic flux Ψ can be calculated from the current which flows through the coil 3, the voltage which is applied to the coil 3, and the ohmic resistance of the coil 3. The measured voltage u(t) is composed of an ohmic component (i(t)*R) and an inductive component ($u_{int}(t)$). The inductive voltage is calculated here from the derivative of the concatenated magnetic flux over time where Ψ is dependent on the change in current i(t) and the air gap x(t).

$$u(t) = i(t)R + u_{ind} = i(t)R + \frac{d\Psi(i, x)}{dt} = i(t)R + \left(\frac{d\Psi(i, x)}{di}\frac{di}{dt} + \frac{d\Psi(i, x)}{dx}\frac{dx}{dt}\right)$$

Given slow actuation, the "magnetic" component of the induction as a result of the change in current is small.

$$u_{ind1} = \frac{d\Psi(i, x)}{di}\frac{di}{dt}$$

The mechanical part of the induction as a result of the movement of the armature then describes the strokes (idle stroke and/or working stroke) of the solenoid valve $$u_{ind2} = \frac{d\Psi(i, x)}{dx}\frac{dx}{dt}$$

The concatenated mechanical flux can be calculated in the following way by means of transposition and integration:

$$\Psi = \int (u(t) - i(t)R)dt$$

In order to determine the needle stroke or determine a stroke of a closure element 11 of a solenoid valve, the magnetic flux Ψ can be determined and subsequently evaluated.

Figure 2:
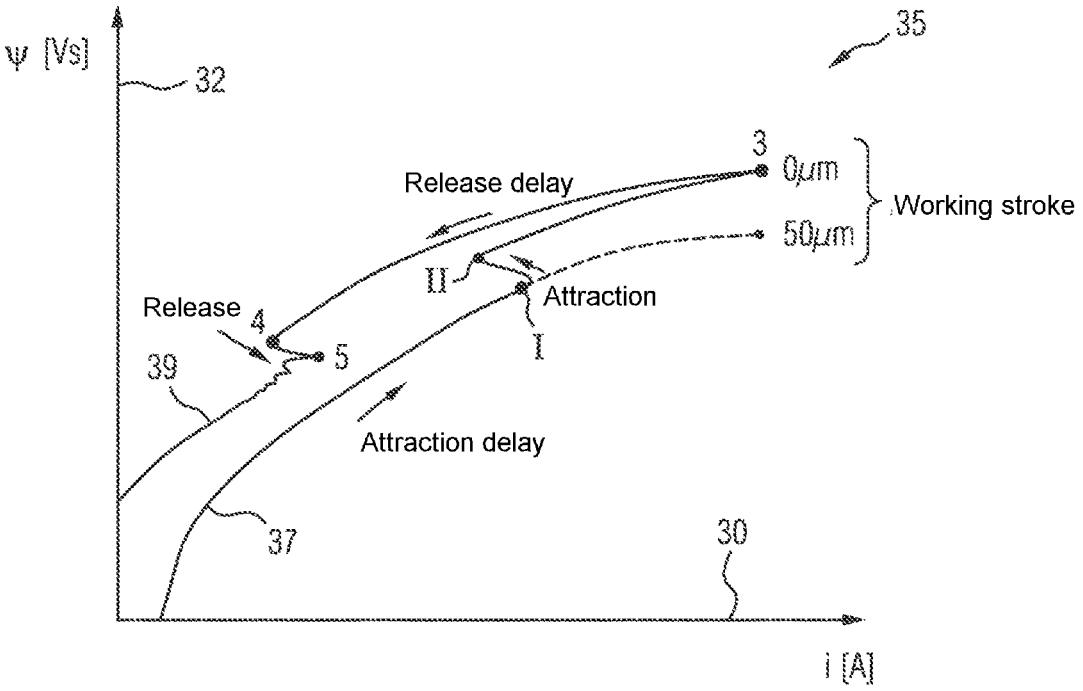
FIG. 2 illustrates graphs of reference data or state trajectories or measurement data of a solenoid valve according to embodiments of the present invention.

The determination of the stroke (e.g. idle stroke and/or working stroke) and also of the pressure can be carried out on the basis of Ψ-I diagrams, like the diagram illustrated in FIG. 2. In this context, the current i flowing through the coil 3 is calculated on an abscissa 30, and the magnetic flux Ψ calculated according to the above equation is plotted on the ordinate 32. FIG. 2 shows in this respect the trajectories (Ψ-I curves) 37 and 39 of a solenoid valve without an idle stroke. The state I corresponds to a state in which the armature 9 bears against the driver element 13 of the closure element 11 and just starts to shift the closure element 11 upward together with the driver element 13, for the purpose of opening. The state I can be determined e.g. by analysis of the graph 35 and, in particular, of the trajectory (or Ψ-I curve) 37 for example as an inflection point at which a gradient changes sign. The working stroke of 50 μm to 0 μm, i.e. the attraction of the armature 9 in the working stroke, takes place between the points I and II. A determination of a stroke and also a determination of a pressure can be carried out in a range before the state I by evaluating the magnetic flux Ψ.

The state trajectory 37 is run through during an attraction process (that is to say during an opening process) and the trajectory 39 is run through during a release process (i.e. during a closing process) of the solenoid valve 1 (for the case without an idle stroke here). The pressure of the fuel can be determined from a comparison with reference data or reference trajectories which are not illustrated in FIG. 2.

According to embodiments of the present invention, the range of the trajectory 37 before the point I is evaluated for a solenoid valve without an idle stroke. In the section between the points I and II the gradient of the curve 37 changes from a positive value to a negative value.

Figure 3:
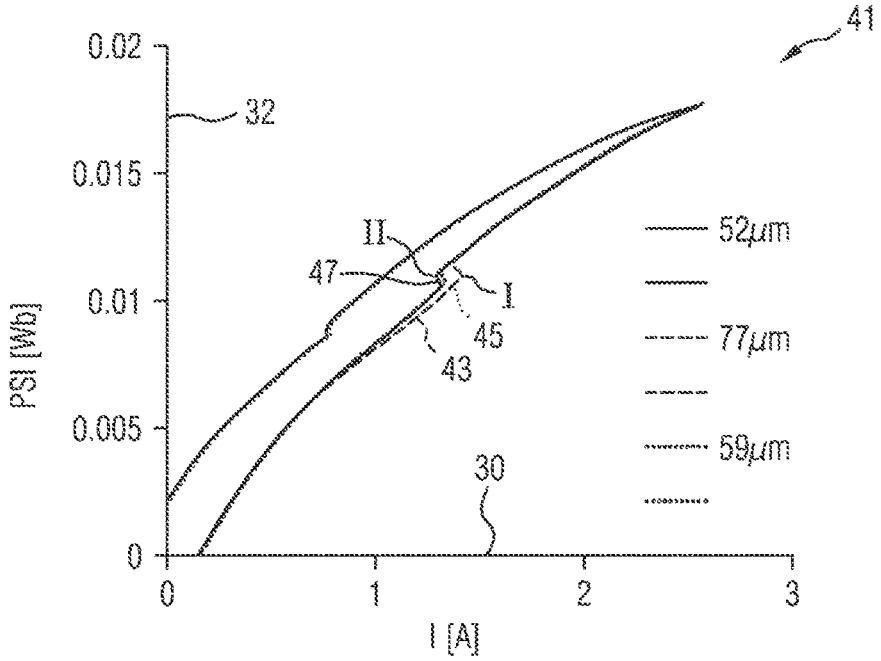
FIG. 3 shows Ψ-I curves of a solenoid valve without an idle stroke for different needle strokes.
Figure 4:
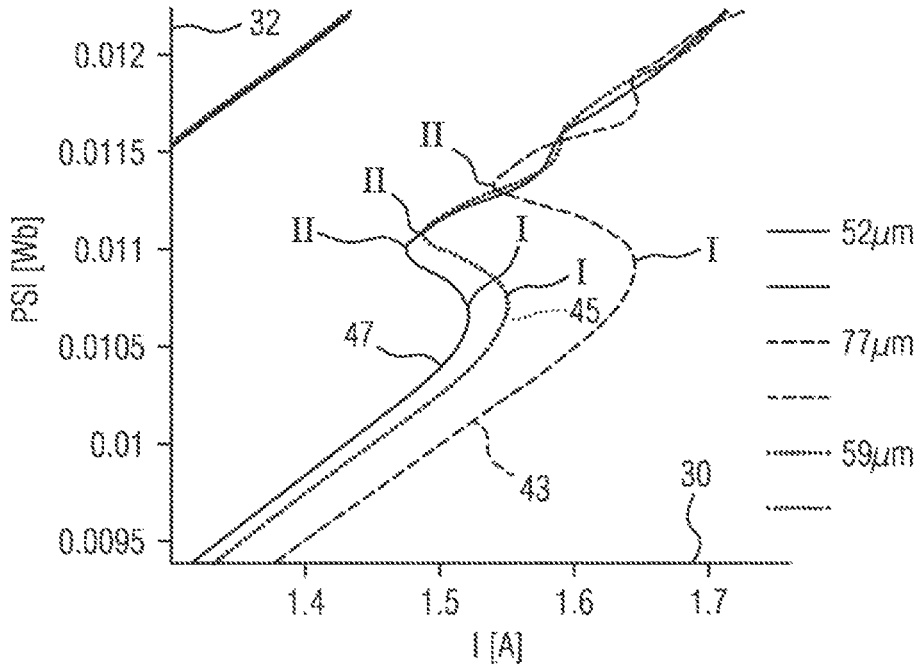
FIG. 4 shows an enlarged view of a detail of the graph illustrated in FIG. 3.

FIG. 3 illustrates a graph 41, wherein the coil current is plotted on the abscissa 30, and the magnetic flux PSI on an ordinate 32. The trajectory or curves 43, 45 and 47 have been implemented by measuring one and the same solenoid valve at various positions of the pole shoe 27, in order to set various working strokes, in particular 77 μm, 59 μm and 52 μm, respectively. As is apparent from FIG. 3, the Ψ-I curves 43, and 47 differ slightly from one another, which is illustrated in an enlarged illustration of a particular detail in FIG. 4. In this context, the measurements have been made at a constant fuel pressure. Reference data for determining a stroke from measurements of the magnetic flux can be determined from the curves 43, 45 and 47. For example, a relationship between the working stroke or pressure and a measured magnetic flux can be determined, e.g. in a range before the state I, or a sensitivity of the magnetic flux can be determined as a function of the working stroke or pressure. After measurement of a magnetic flux of a solenoid valve with an unknown working stroke or idle stroke or pressure, the desired unknown stroke (in particular working stroke, idle stroke) of the solenoid valve or pressure of the fuel can be determined from the sensitivity or from the relationship between the magnetic flux and stroke or the pressure.

Figure 5:
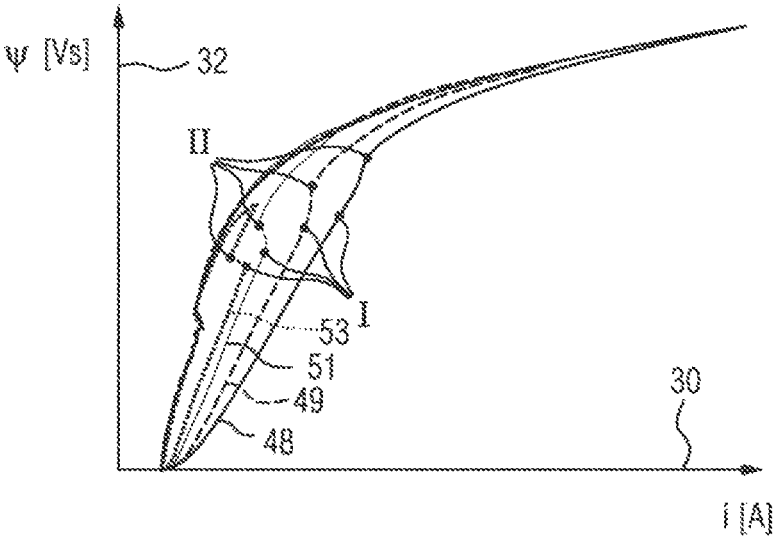
FIG. 5 illustrates graphs of state trajectories which are obtained by means of various actuation voltage profiles.

The form of the Ψ-I curve at various actuation voltages (3 V . . . 18 V) is illustrated in FIG. 5 by means of trajectories 48 (exciter voltage 18 V), 49 (exciter voltage 6 V), 51 (exciter voltage 12 V) and 53 (exciter voltage 3 V). As is apparent from FIG. 5, at relatively high voltages it becomes increasingly more difficult to detect the states I and II reliably, since only small changes in gradient occur. In the case of e.g. an exciter voltage of 18 V, it may be difficult to detect the state I reliably. Therefore, reference curves can be measured, or a measurement for determining a stroke at relatively low exciter voltages, e.g. between 3 V and 12 V, can be carried out.

Figure 6:
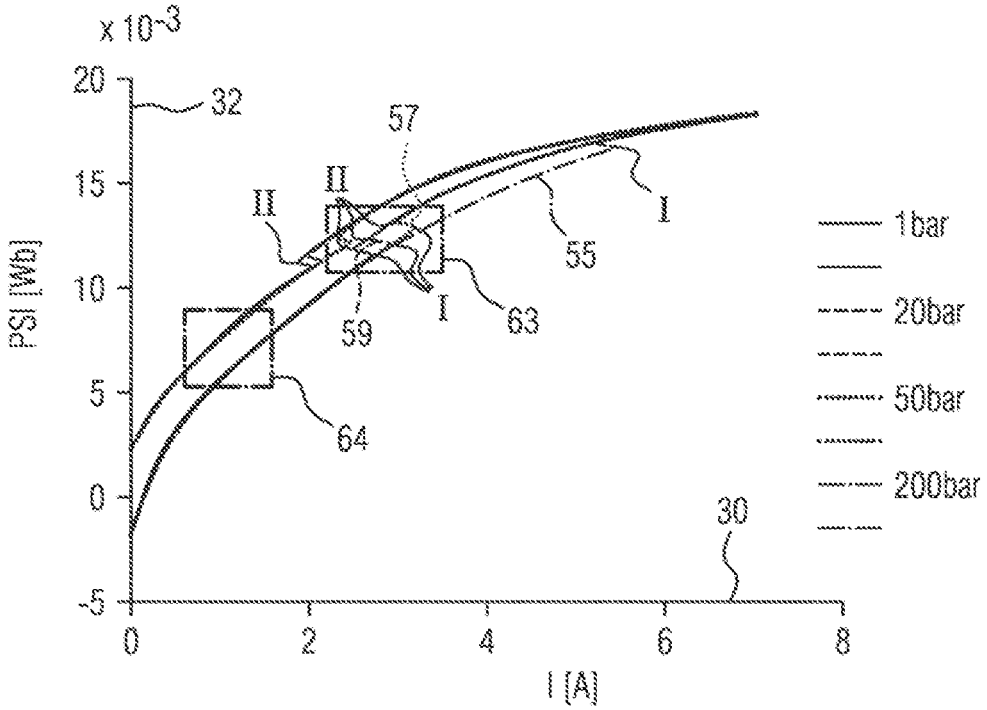
FIG. 6 shows Ψ-I curves of a solenoid valve for various pressures.
Figure 7:
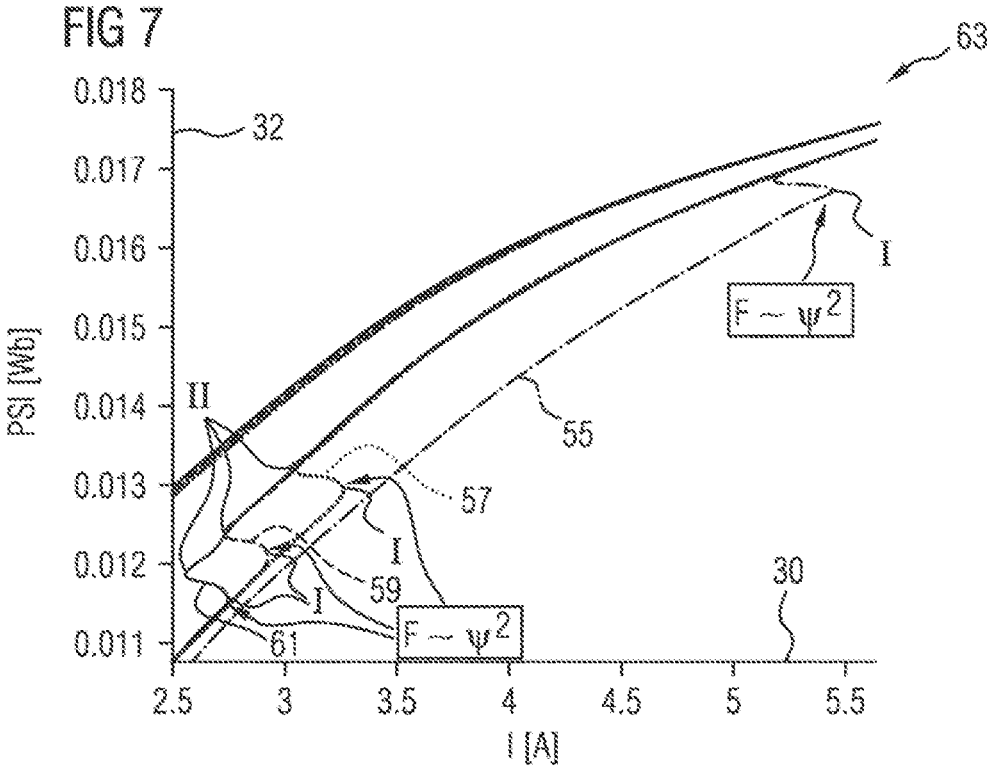
FIG. 7 shows an enlarged view of a detail of the curves illustrated in FIG. 6.
Figure 8:
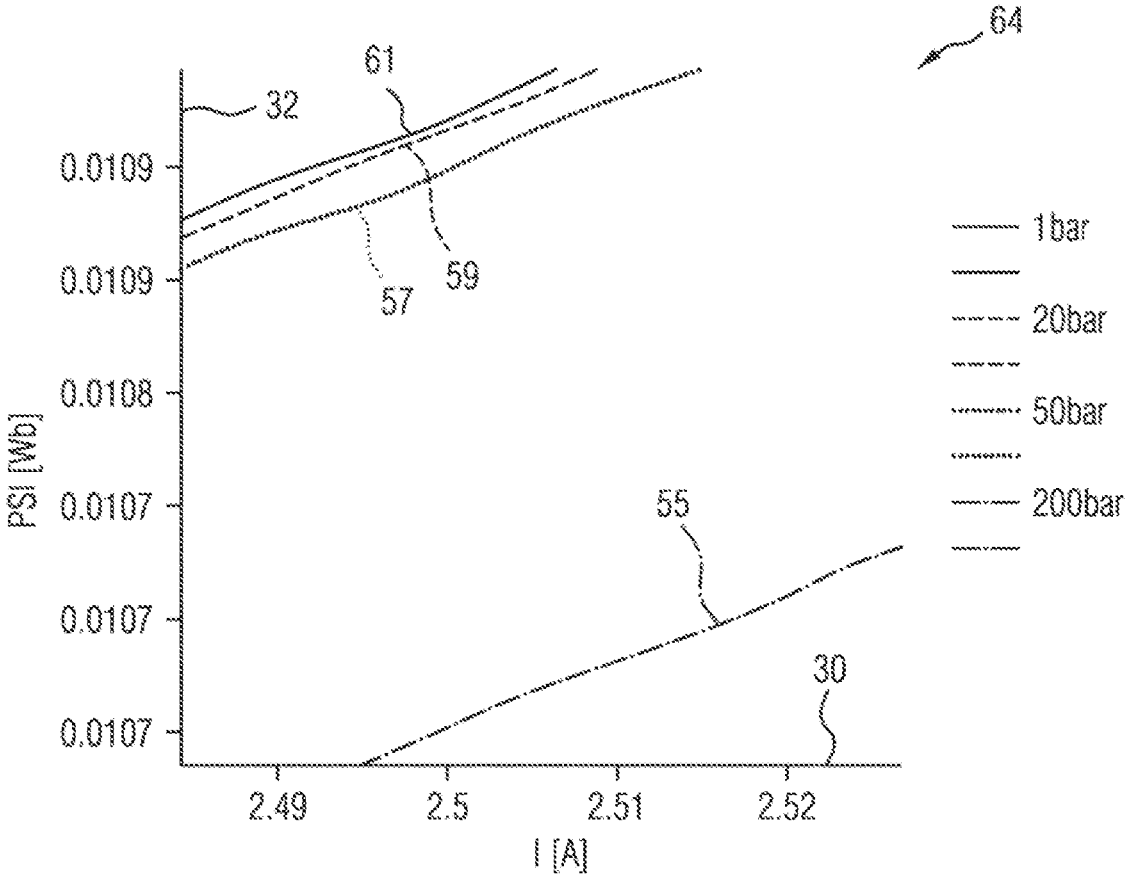
FIG. 8 illustrates a different enlarged detail of the curves illustrated in FIG. 6.

FIGS. 6, 7 and 8 illustrate Ψ-I curves 55, 57, 59 and 61 which have been recorded on one and the same solenoid valve at various pressures specifically 200 bar, 50 bar, 20 bar and 1 bar of a fuel, wherein the current through the coil 3 is plotted on the abscissa 30, and the magnetic flux is respectively plotted on the ordinate 32. FIGS. 7 and 8 show here specific details 63 and 64 of the curves 55, 57, 59 and 61 which are illustrated on a relatively small scale in FIG. 6. According to embodiments of the invention, a fuel pressure is determined by obtaining Ψ-I curves from magnet actuators, in particular solenoid valves or injectors, in injection systems. In Ψ-I curves it is possible to recognize air gaps or magnetic gap forces and magnetic movement forces which also change in the event of changes in pressure (possibly owing to mechanical deformations). Furthermore, the forces during which the actuator moves at different pressures can change, since different pressures can cause different opposing forces of the movement.

FIGS. 6, 7 and 8 show Ψ-I curves of a solenoid valve or injector at different pressures. In this context, changed gaps/strokes are recognizable, along with the force which is to be applied at the start of the movement in the state I.

According to one alternative of the pressure determining method, as illustrated in FIG. 7 the magnetic flux 65 is determined (precisely) in the state I, in order to calculate the fuel pressure therefrom. At this location or in this state, there can in fact be a force equilibrium between the force generated on the basis of the fuel pressure and the force generated on the basis of the magnetic field or the magnetic flux. The force which is generated by the magnetic flux is proportional here to the square of the magnetic flux. The pressure of the fuel should therefore be proportional to the square of the magnetic flux evaluated in the state I.

Furthermore, a relationship between the magnetic flux in the state I (and/or before the state I) and the previously known pressure can be determined from the multiplicity of Ψ-I curves 55, 57, 59 and 61. This determined relationship can be used to evaluate a Ψ-I curve of a solenoid valve with a pressure which is to be determined, in order to carry out a pressure determination. Furthermore, a sensitivity (for example a difference quotient between the magnetic flux and the pressures or a reciprocal value of this difference quotient) can be formed from the differences between the magnetic flux at various pressures, in particular in the state I, and said sensor can be used for (relative) pressure determination of further measurements.

FIG. 8 illustrates the range 64 of the curves 55, 57, 59 and 61 illustrated in FIG. 6. The range 64 occurs before the state I, i.e. in a range in which the armature bears against the driver element 13 or the closure element 11 and is in contact, but does not yet move the driver element and the closure element 13 to open. In one embodiment, this range can also be used to determine the fuel pressure. As is apparent, the magnetic fluxes of the curves 55, 57, 59 and 61 differ, wherein there is clearly no linear relationship between changes in a magnetic flux and changes in the pressure here. For this reason, various sensitivities can be determined and stored in various ranges of the magnetic flux and used later for the interpretation or evaluation of further measurement curves for pressure determination.

A high level of accuracy of the method can be achieved if Eddy currents within the armature or other elements of the solenoid valve are relatively low. In order to ensure low Eddy currents, a relatively slow actuation for energizing the coil 3 can be used. In this context, a relatively low boost voltage such as e.g. between 3 V and 12 V can be used, as has also been mentioned in conjunction with FIG. 5. In any case, the state I can be reliably determined for these relatively low boost voltages. Alternatively or additionally, an actuator (in particular comprising the armature and the nozzle) can be used which is changed in its design in order to reduce Eddy currents. For this purpose, e.g. a slotted armature or an armature can be provided which is constructed from layers of ferromagnetic material which are each electrically insulated from one another. With such an armature, it is also possible to apply current to the coil of the solenoid valve by means of the standard actuation, since the curve profiles during the stroke movements are significantly more pronounced.

Like the pressure determination, the stroke determination is also possible without measuring the complete curves. It can be sufficient e.g. to measure the curves only up to the state I in each case. It can be advantageous here that the determination of a stroke can be carried out without opening an injector (injection). Therefore, the measurement can be carried out without an adverse effect on emissions.

Both the pressure determination and the determination of a stroke can be carried out here with or without reference data. A difference between pressures can be inferred from a difference in magnetic flux (under various pressure conditions). By means of reference data it is possible to carry out calibration, with the result that an absolute pressure determination is also possible. The method can be implemented e.g. in an engine control device.

The invention claimed is:

1. A method for determining a pressure of a fuel, which is to be injected into a combustion chamber via a controllable closure element of a solenoid valve, the method comprising:

generating a current through a coil of the solenoid valve to generate a magnetic field, in order to generate a magnetic force acting on an armature, which magnetic force shifts the armature in the direction of the opening of the closure element;

determining a magnitude of a magnetic flux of the magnetic field before or when a first state at which the armature starts to shift the closure element is reached; and determining a magnitude of the pressure on the basis of the determined magnitude of the magnetic flux, wherein a sensitivity of the magnitude of the magnetic flux as a function of the magnitude of the pressure is known from previous measurements on the solenoid valve; and wherein the determination of the magnitude of the pressure is carried out as a determination of a change in pressure on the basis of the determined magnitude of the magnetic flux and the known sensitivity.

2. The method of claim 1, wherein the magnitude of the pressure is also determined from reference data which contain at least one magnitude of the magnetic flux at a known pressure.

3. The method of claim 1, wherein the magnitude of the magnetic flux is determined when the first state is reached, and wherein the magnitude of the pressure is determined as being proportional to the square of the magnitude of the magnetic flux.

4. The method of claim 1, wherein the magnitude of the magnetic flux is determined before the first state is reached, and a magnitude of at least one of an idle stroke and a working stroke of the armature is determined from the magnitude of the magnetic flux, wherein a sensitivity of the magnitude of the magnetic flux is taken into account as a function of the magnitude of the at least one of the idle stroke and the working stroke.

5. The method of claim 1, wherein pairs of a magnitude of a current and a magnitude of the magnetic flux, which correspond to a state trajectory of the closure element during a closing process of the solenoid valve, are considered, and wherein the first state is associated with a pair in which a sign of a gradient changes along the state trajectory.

6. The method of claim 1, wherein in a graph in which the current through the coil is plotted on the abscissa, and the magnetic flux is plotted on an ordinate, the first state is identified as being assigned to one of a location at which a positive gradient changes into a negative gradient and a location between a section of a positive gradient and a section of a negative gradient.

7. The method of claim 1, wherein initially a boost voltage between about 3 V and about 65 V, and a holding voltage between about 6 V and about 14 V are used to generate the current flow through a coil; wherein the armature comprises a slotted ferromagnetic material and layers of ferromagnetic material which are electrically insulated from one another, in order to reduce Eddy currents.

8. A pressure measuring system, comprising:

a solenoid valve having a controllable closure element, a coil and an armature, wherein a magnetic field is generated by current flow through the coil, in order to generate a magnetic force on the armature, which magnetic force shifts the armature in the direction of opening the closure element; and a fuel pressure determiner configured to determine the pressure of a fuel to be injected into a combustion chamber via the closure element of the solenoid valve, wherein the armature comprises, in particular, a slotted ferromagnetic material and/or layers of ferromagnetic material which are electrically insulated from one another, in order to reduce Eddy currents, wherein the fuel pressure determiner determines the pressure based on a magnitude of a magnetic flux of the magnetic field before or when a first state is reached in which the armature starts to move the closure element.

9. A control unit for determining a pressure of a fuel which is to be injected into a combustion chamber via a controllable closure element of a solenoid valve, the solenoid valve further comprising an armature and a coil, the control unit comprising:

a driver circuit connected to the coil of the solenoid valve, the driver circuit generating a current flow through the coil in order to generate a magnetic field with a magnetic force that acts on the armature of the solenoid valve, which magnetic force shifts the armature in a direction for opening the closure element, wherein the control unit is configured to determine a magnitude of a magnetic flux of the magnetic field before or when a first state in which the armature starts to shift the closure element is reached, and determine a magnitude of the pressure on the basis of the determined magnitude of the magnetic flux, wherein the magnitude of the magnetic flux is determined before the first state is reached, and a magnitude of at least one of an idle stroke and a working stroke of the armature is determined from the magnitude of the magnetic flux, wherein a sensitivity of the magnitude of the magnetic flux is determined as a function of the magnitude of the at least one of the idle stroke and the working stroke.

10. The control unit of claim 9, wherein a sensitivity of the magnitude of the magnetic flux as a function of the magnitude of the pressure is known from previous measurements on the solenoid valve; and wherein the determination of the magnitude of the pressure is carried out by the control unit as a determination of a change in pressure on the basis of the determined magnitude of the magnetic flux and the known sensitivity.

11. The pressure measuring system of claim 8, wherein the fuel pressure determiner determines the pressure by determining a change in pressure on the basis of the determined magnitude of the magnetic flux and the known sensitivity.

12. The pressure measuring system of claim 8, wherein a magnitude of at least one of an idle stroke and a working stroke of the armature is determined by the fuel pressure determiner from the magnitude of the magnetic flux, wherein a sensitivity of the magnitude of the magnetic flux is determined as a function of the magnitude of the at least one of the idle stroke and the working stroke.

* * * * *